US006310467B1

(12) United States Patent
Sauer

(10) Patent No.: US 6,310,467 B1
(45) Date of Patent: Oct. 30, 2001

(54) LDO REGULATOR WITH THERMAL SHUTDOWN SYSTEM AND METHOD

(75) Inventor: Don R. Sauer, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/815,410

(22) Filed: Mar. 22, 2001

(51) Int. Cl.[7] ..... G05F 1/575
(52) U.S. Cl. ..... 323/273; 323/280
(58) Field of Search ..... 323/273, 274, 323/276, 280, 281, 901, 907

(56) References Cited

U.S. PATENT DOCUMENTS

| | | | | |
|---|---|---|---|---|
| 5,552,697 | * | 9/1996 | Chan | 323/282 |
| 5,589,761 | * | 12/1996 | Nelson et al. | 323/285 |
| 5,677,558 | * | 10/1997 | McGlinchey | 257/370 |
| 5,686,821 | * | 11/1997 | Brokaw | 323/273 |
| 5,861,736 | | 1/1999 | Corsi et al. | 323/273 |
| 5,929,617 | | 7/1999 | Brokaw | 323/280 |
| 6,229,289 | * | 5/2001 | Piovaccari et al. | 323/268 |

OTHER PUBLICATIONS

Simpson, Chester, "Linear Regulators: Theory of Operation and Compensation", National Semiconductor Corporation, AN–1148, May 2000, pp. 1–8.

* cited by examiner

*Primary Examiner*—Adolf Deneke Berhane
(74) *Attorney, Agent, or Firm*—Merchant & Gould PC

(57) ABSTRACT

A method and apparatus is directed to a thermal shut down for a low drop out (LDO) regulator including a MOS transistor. An error amplifier controls the gate of the MOS transistor by comparing the regulator output voltage to a reference voltage that is generated by a reference circuit. To enhance power supply rejection and improve regulation, the error amplifier and the reference circuits are powered by a potential at an internal power supply node. A power control circuit selectively couples the internal power supply node to one of the regulated output voltage and the unregulated supply voltage. A start-up circuit may be employed to ensure that regulation begins when power is applied. A temperature sensor circuit detects when the operating temperature exceeds a predetermined temperature and activates a supply transfer circuit to couple the unregulated supply to the internal power supply node. After the internal power supply node reaches the unregulated power supply potential, a shutdown circuit deactivates the MOS transistor. A diode is coupled between the regulator output and the internal power supply node to prevent current flowing from the internal power supply node to the load when the over-temperature condition exists. A transistor mirror may be configured to couple the unregulated supply voltage to the internal power supply node when activated. The thermal characteristics of a transistors threshold voltage may be employed as a temperature sensor. Another transistor may deactivate the MOS transistor by coupling the gate of the MOS transistor to the unregulated supply voltage.

17 Claims, 6 Drawing Sheets

LDO REGULATOR WITH THERMAL SHUTDOWN SYSTEM AND METHOD

FIELD OF THE INVENTION

The present invention relates to low-dropout regulators. In particular, the present invention relates to a method and apparatus that provides for a low-dropout regulator that includes thermal protection.

BACKGROUND OF THE INVENTION

Voltage regulators are often used to provide a relatively constant voltage source to other electronic circuits. Some regulators are limited in their effectiveness in a particular application. For example, some regulators have a high "drop-out" voltage. A "drop-out" voltage is the minimum voltage difference between the input voltage and the output voltage that is necessary to maintain proper regulation. Large drop-out voltages result in wasted power, and raise the minimum power supply requirements for maintaining regulation.

A low-dropout regulator (hereinafter referred to as an "LDO regulator") is useful in applications where it is desired to maintain a regulated voltage that is sufficiently close to the input voltage. For example, LDO regulators are useful in battery-powered applications where the power supply voltage is exceedingly low.

A typical LDO regulator (100) is shown in FIG. 1. The LDO regulator (100) includes a PMOS transistor (MP10), a first resistor (R10), a second resistor (R11), and a voltage control block (110). The PMOS transistor (MP10) has a drain connected to an output terminal (VOUT), a gate connected to node N10, and a source connected to an input voltage (VIN). The first resistor (R10) is series connected between nodes the regulator output node (VREG) and node N11. The second resistor (R2) is series connected between nodes N11 and a circuit ground potential (GND). The voltage control block (110) has three input terminals (VIN, VREF, SENSE) and an output terminal (PCTL). In the voltage control block (110), the first input terminal (VIN) is connected to the input voltage (VIN), the second input terminal (VREF) is connected to a reference voltage potential (VREF), and the third input terminal (SENSE) is connected to node N10.

A load (ZL) is connected to the output terminal (VREG) of the LDO regulator (100). The LDO regulator (100) controls the gate of the PMOS transistor (MP10) to ensure that regulation of the output voltage (VREG) is maintained. The voltage control block (110) monitors the SENSE input terminal and controls the gate of the PMOS transistor (MP10) through the PCTL output terminal. Resistors R10 and R11 form a resistor divider that produces a signal that is related to the regulated output voltage (VREG). When the SENSE input terminal and the reference signal (VREF) are substantially the same, the LDO is properly maintaining regulation of the output voltage to the load (ZL).

SUMMARY OF THE INVENTION

The present invention is directed to an apparatus and method for an improved LDO regulator including a temperature protection circuit. The LDO regulator has improved power supply rejection and improved regulation by selectively operating the LDO regulator components from the regulated voltage. The LDO regulator components are selectively operated from the unregulated power supply when the operating temperature exceeds a predetermined temperature, which is detected by a temperature sensor.

Briefly stated, a method and apparatus is directed to a thermal shut down for a low drop out (LDO) regulator including a MOS transistor. An error amplifier controls the gate of the MOS transistor by comparing the regulator output voltage to a reference voltage that is generated by a reference circuit. To enhance power supply rejection and improve regulation, the error amplifier and the reference circuits are powered by a potential at an internal power supply node. A power control circuit selectively couples the internal power supply node to one of the regulated output voltage and the unregulated supply voltage. A start-up circuit may be employed to ensure that regulation begins when power is applied. A temperature sensor circuit detects when the operating temperature exceeds a predetermined temperature and activates a supply transfer circuit to couple the unregulated supply to the internal power supply node. After the internal power supply node reaches the unregulated power supply potential, a shutdown circuit deactivates the MOS transistor. A diode is coupled between the regulator output and the internal power supply node to prevent current flowing from the internal power supply node to the load when the over-temperature condition exists. A transistor mirror may be configured to couple the unregulated supply voltage to the internal power supply node when activated. The thermal characteristics of a transistors threshold voltage may be employed as a temperature sensor. Another transistor may deactivate the MOS transistor by coupling the gate of the MOS transistor to the unregulated supply voltage.

According to a feature of the invention, an LDO regulator includes an error amplifier and a reference circuit that are powered by an internal power supply node. The internal power supply node is selectively coupled to one of a regulated voltage and an unregulated power supply voltage. The error amplifier compares the regulated voltage to a reference voltage from the reference circuit to control the gate of a MOS device. The operation of the error amplifier and the reference circuit from the regulated power supply enhances power supply rejection of the LDO regulator.

According to a further feature of the invention, the threshold voltage of a transistor is arranged to detect an over-temperature condition and activate a supply transfer circuit. The supply transfer circuit couples the unregulated power supply voltage to an internal power supply node when activated. The gate of the MOS device is coupled to the unregulated power supply voltage when the internal power supply node is the unregulated power supply voltage.

In accordance with an embodiment of the invention, an apparatus regulates a regulation voltage across a load from an unregulated power supply. The apparatus includes a series regulator circuit is arranged to selectively couple power from the unregulated power supply to the load in response to a control signal. A feedback circuit is arranged to provide a feedback voltage from the regulation voltage, wherein the feedback voltage is at least a portion of the regulation voltage. A power control circuit is arranged to selectively couple power from the unregulated power supply to an internal power supply when activated by an over-temperature signal. A temperature sensor circuit is arranged to provide an over-temperature signal when an over-temperature condition is detected. A diode circuit is arranged to couple power from the regulation voltage to the internal power supply when the power control circuit is deactivated such that the internal power supply is regulated when the power control circuit is deactivated. An error amplifier circuit is arranged to produce the control signal in response to a reference voltage and the feedback voltage, wherein the error amplifier is arranged to operate from the internal power supply whereby the regulation voltage has an improved power supply rejection ratio.

In accordance with another embodiment of the invention, an apparatus that regulates a regulation voltage across a load from an unregulated power supply includes a means for regulating selectively couples power from the unregulated power supply to the load in response to a control signal. A means for coupling unregulated power selectively couples power from the unregulated power supply to an internal power supply when activated by an over-temperature signal. A means for sensing produces an over-temperature signal when an over-temperature condition is detected. A means for coupling regulated power couples power from the regulation voltage to the internal power supply when the internal power supply is less than the regulation voltage. A means for providing feedback provides a feedback voltage from the regulation voltage, wherein the feedback voltage is at least a portion of the regulation voltage. A means for controlling provides the control signal in response to the feedback voltage and a reference voltage such that the regulation voltage across the load is regulated by the means for controlling and the means for regulating when the over-temperature signal is deactivated, wherein the means for controlling operates from the internal power supply.

In accordance with yet another embodiment of the invention, a method for regulating a regulation voltage across a load from an unregulated power supply that has an associated unregulated power supply voltage includes: controlling a series regulation circuit with a control signal, coupling power from the unregulated power supply to the load in response to the control signal, coupling power from the series regulation circuit to an internal power supply that has a corresponding internal power supply voltage when the internal power supply voltage is lower than the regulation voltage, producing a feedback voltage that corresponds to at least a portion of the load regulation voltage, producing a first and second reference voltage with a reference circuit, producing the control signal with an error amplifier circuit in response to the feedback voltage to the first reference voltage, sensing an over-temperature condition with a temperature sensor circuit that utilizes the second reference voltage, producing the over-temperature signal in response to the over-temperature condition, coupling the unregulated power supply to an internal power supply when activated by the over-temperature sensor signal, disabling the series regulation circuit after coupling the unregulated power supply to the internal power supply, and operating the error amplifier circuit and the reference circuit from the internal power supply such that the regulation voltage has improved power supply rejection during regulation.

A more complete appreciation of the present invention and its improvements can be obtained by reference to the accompanying drawings, which ;ae briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention relates to low-dropout voltage regulators and more particularly to low voltage dropout regulators that include a thermal protection circuit. The present invention provides for improved performance in power-supply rejection (PSR) as well as other regulation performance criteria by providing power to the internal regulator components from the regulated supply. When an over-temperature condition exists in the LDO regulator, the LDO regulator is effectively shut-down by disabling the output drive circuit. When the output drive circuit is disabled, the internal power supply for the regulator components is switched over to the upstream ("raw") unregulated power supply.

Figure 1:
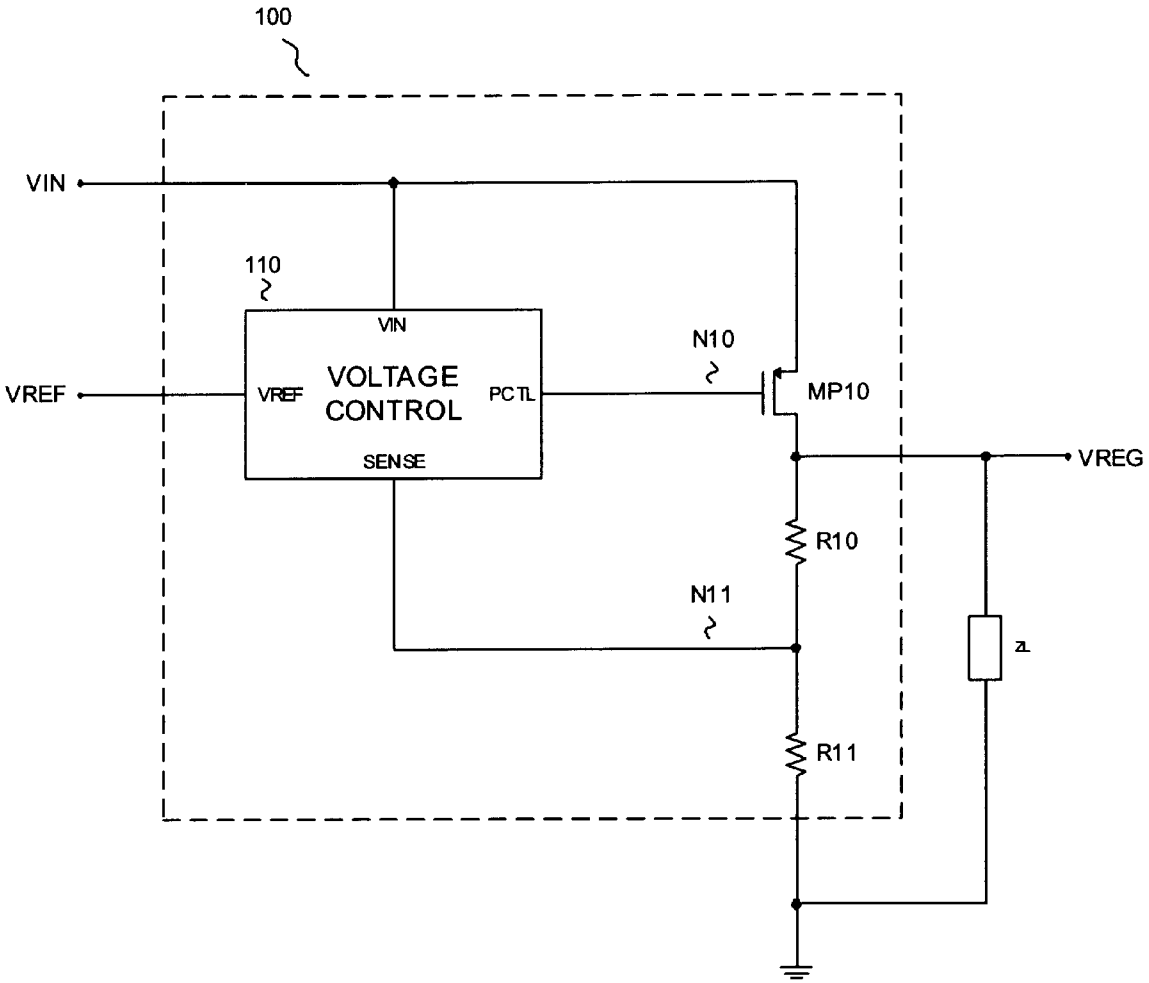
(PRIOR ART) FIGURE 1
FIG. 1 is a schematic diagram of a conventional LDO voltage regulator.
Figure 2:
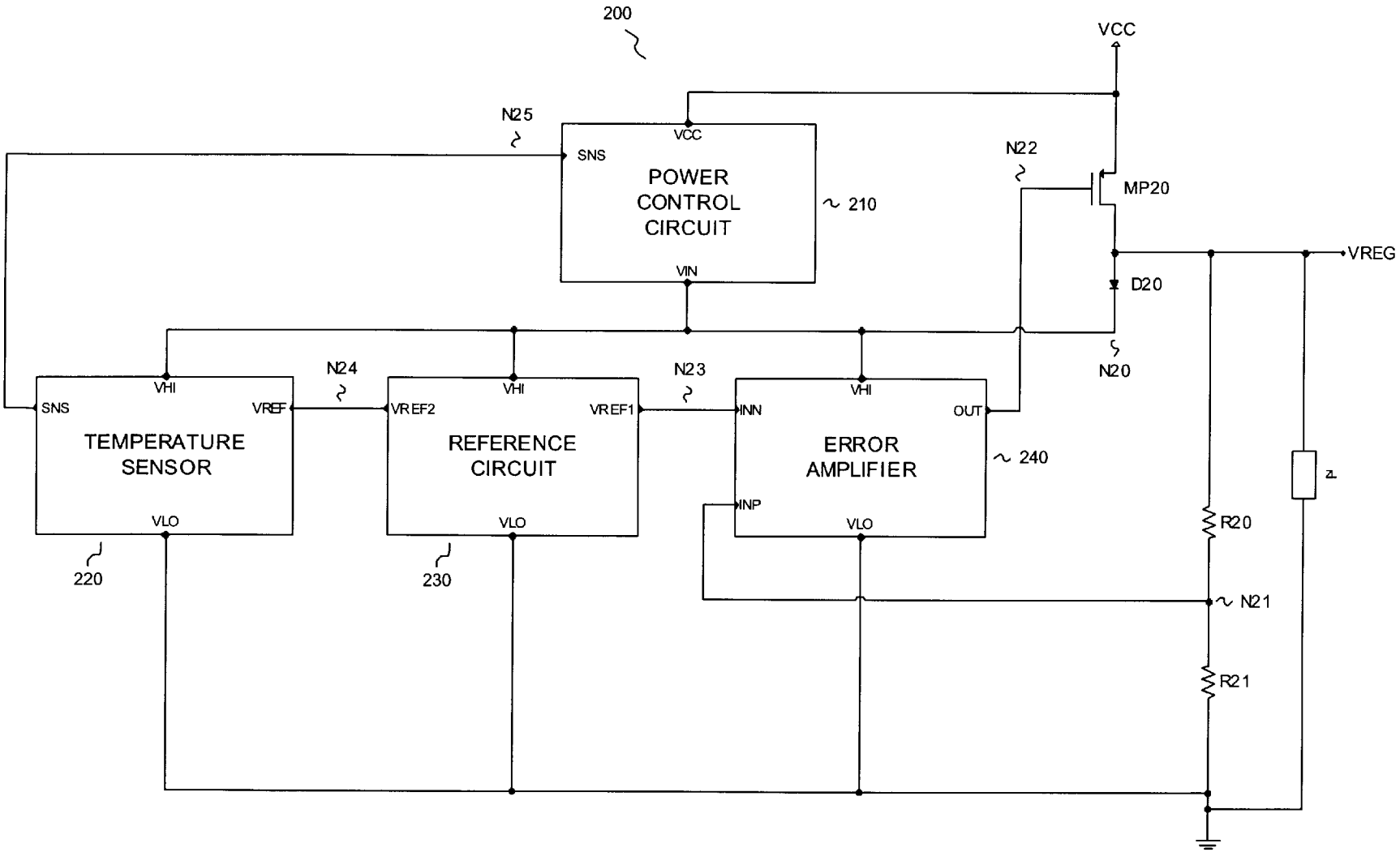
FIG. 2 is a schematic diagram illustrating an LDO regulator.

FIG. 2 is a schematic illustrating an example of an LDO regulator that is in accordance with the present invention. In FIG. 2, the LDO regulator (200) includes a power control circuit (210), a temperature sensor (220), a reference circuit (230), an error amplifier (240), a PMOS transistor (MP20), a first resistor (R20), and a second resistor (R21). The LDO regulator (200) regulates a voltage (VREG) across a load (ZL).

The power control circuit (210) includes an input power terminal (VCC), a sense input terminal (SNS), and an output power terminal (VIN). The power control circuit optionally includes another power supply terminal (VLO, not shown) that is coupled to a circuit ground potential (GND). The input power terminal (VCC) is coupled to the unregulated power supply (VCC). The output power supply terminal (VIN) is coupled to node N20, which operates as a power supply terminal for the internal regulator components. The sense input terminal (SNS) is coupled to node N25.

In some instances, the circuit ground potential (GND) connection in the power control circuit (210) may not be necessary. For example, the power control circuit may include a single transistor that is configured as a switch coupling the VCC node to the VIN node (N20), by-passing the PMOS transistor and supplying power directly to the internal components. In this instance, no circuit ground potential is necessary. The power control circuit disables conduction between the VREG node and the internal power supply at node N20. The power control circuit is responsive to the signal that is provided from Node N25 at the SNS input terminal.

The PMOS transistor (MP20) includes a drain coupled to the regulator output (VREG), a gate connected to node N22, and a source connected to the unregulated (upstream) power supply voltage (VCC). The diode (D20) includes an anode connected to the regulator output (VREG), and a cathode connected to node N20. An external load (ZL) is connected to the regulator output (VREG). The PMOS transistor (MP20) operates as a drive circuit that is controlled by the regulator internal components to drive current into the external load (ZL) to maintain regulation. Although the transistor shown is a PMOS-type transistor, the entire design may be rearranged for using an NMOS-type transistor to regulate the output drive.

Resistor R20 is coupled between nodes VREG and N21. Resistor R21 is coupled between node N21 and a circuit potential ground (GND). The LDO uses node N21 as a sense point for feedback between the internal regulator components and the regulated output (VREG). Resistors R20 and R21 may be replaced by another circuit that includes one or more components that couple at least a portion of the regulated output signal to the internal components. In one example, the resistors are replaced by diodes that divide the regulated output voltage in half. Other circuits may also provide an adequate feedback signal from the regulated output signal to the internal regulator components.

The temperature sensor circuit (220) includes a high power supply terminal (VHI), a low power supply terminal (VLO), a reference voltage input terminal (VREF), and an output terminal (SNS). The high power supply terminal (VHI) is coupled to node N20. The low power supply terminal (VLO) is coupled to the circuit ground potential (GND). The reference voltage input terminal (VREF) is coupled to node N24. The output terminal (SNS) is coupled to node N25.

The reference circuit (230) includes a high power supply terminal (VHI), a low power supply terminal (VLO), a first reference voltage output (VREF1), and a second reference voltage output (VREF2). The high power supply terminal (VHI) is coupled to node N20. The low power supply terminal (VLO) is coupled to the circuit ground potential (GND). The first reference voltage output (VREF1) is coupled to node N23, while the second reference voltage output (VREF2) is coupled to node N24.

The reference circuit may be a band gap reference or any other type of voltage reference as is necessary for the system operation.

The error amplifier (240) includes a high power supply terminal (VHI), a low power supply terminal (VLO), an inverting amplifier input terminal (INN), a non-inverting amplifier input terminal (INP), and an amplifier output terminal (OUT). The high power supply terminal (VHI) is coupled to node N20. The low power supply terminal (VLO) is coupled to the circuit ground potential (GND). The non-inverting amplifier input terminal (INP) is coupled to node N21, while the inverting input terminal (INN) is coupled to node N23. The amplifier output terminal (OUT) is coupled to node N22.

The reference circuit (230) provides a first reference voltage (VREF1) for the inverting input (INN) of the error amplifier (240). The resistor divider formed by resistors R20 and R21 provide another reference voltage at node N21, which is coupled to the non-inventing input (INP) of the error amplifier (240). The error amplifier compares the voltage at the inverting input terminal (INN) to the voltage at node N21 (INP) to produces a signal at node N22. The PMOS transistor (MP20) works in conjunction with the error amplifier circuit (240) to provide the regulated voltage (VREG). To accomplish regulation, the error amplifier circuit (240) controls node N22, which is the gate of the PMOS transistor (MP20).

The error amplifier uses the first reference potential (REF1) from the reference circuit (230), and the resistor divider output to set the regulation voltage. The ratio of resistors R20 and R21 adjusts the output potential at the VREG output. For example, when resistors R20 and R21 are of equal value, the regulated output voltage (VREG) will be roughly twice the first reference potential (VREF1) at node N23. In one example, the first reference potential (VREF 1) is the output voltage for a band gap reference (~1.2V), and the output voltage is roughly 2.4V.

The temperature sensor circuit (220), reference circuit (230), and the error amplifier (240) operate with a high power supply (VHI) coupled to node N24 and a low power supply (VLO) coupled to a circuit ground potential (GND). Thus, node N24 is used as an internal power supply for the regulator components. The power control circuit (210) selectively couples the VCC power supply potential to the internal power supply at node N24 in response to a sense signal. The diode (D20) blocks conduction in the reverse direction towards the regulator output (VREG). Thus, diode D20 prevents current flow from the internal regulator components to the load.

The reference circuit (230) provides a second reference voltage (VREF2), which is used by the temperature sensor circuit (220) to determine when the temperature exceeded some predetermined threshold. The temperature sensor senses thermal temperatures that are generated within the regulator circuit (predominately from PMOS transistor MP20). When the thermal temperature exceeds some minimum threshold, the sense output (SNS) of the temperature sensor circuit (220) produces either a voltage (or current) output. The voltage (or current) output indicates that an over-temperature condition has occurred. In one example, the output sinks current, drawing current from the SNS input terminal of the power control circuit (210) at node N25. In another example, the output is a voltage that controls logic or transistors in the power control circuit (210).

Figure 3:
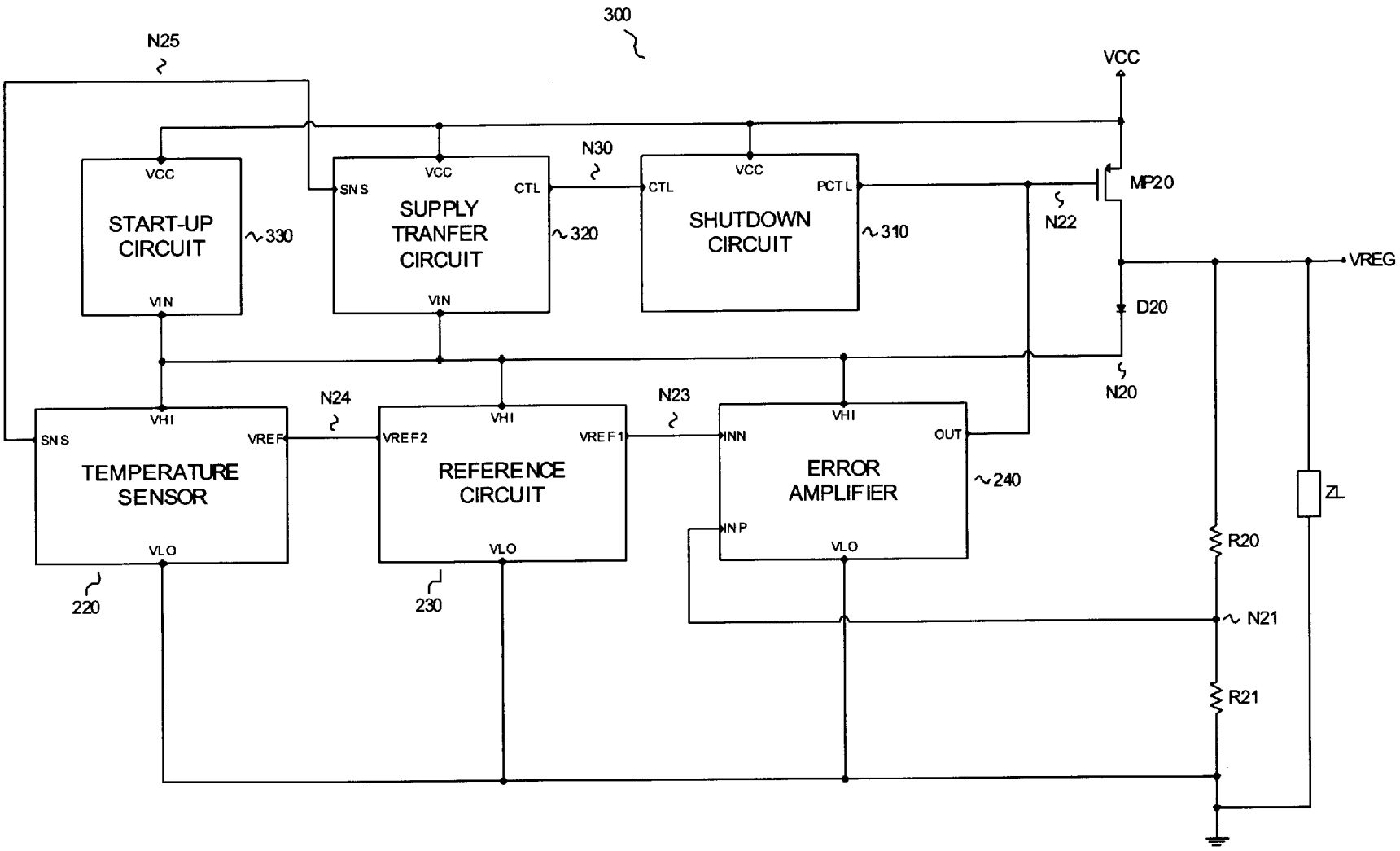
FIG. 3 is a schematic diagram illustrating another exemplary LDO regulator.

FIG. 3 illustrates another example of the present invention. Like components from FIGS. 2 and 3 are labeled identically. The power control circuit (210) from FIG. 2 is replaced with a shutdown circuit (310), a supply transfer circuit (320), and a start-up circuit (330).

The start-up circuit (330) includes a high power supply terminal (VCC) and an output terminal (VIN). The high power supply terminal (VCC) is coupled to the unregulated power supply (VCC). The output terminal (VIN) is coupled to node N20. The start-up circuit may also include a low power supply terminal (not shown) that is coupled to the circuit ground potential (GND). The start-up circuit ensures that the PMOS transistor (MP20) and the internal regulator components will enter into proper regulation when the power supplies are initially activated. For example, when power is initially activated, the start-up circuit couples power from VCC to node N20.

The supply transfer circuit (320) includes a high power supply terminal (VCC), a sense input terminal (SNS), an output control terminal (CTL), and an output power supply terminal (VIN). The high power supply terminal (VCC) is coupled to the unregulated power supply (VCC). The output terminal (VIN) is coupled to node N20. The sense input terminal (SNS) is coupled to node N25, and the control output terminal (CTL) is coupled to node N30. The supply transfer circuit (320) may also include a low power supply terminal (not shown) that is coupled to the circuit ground potential (GND). In response to a signal that is received from the sense input terminal (SNS) at node N25, the supply transfer circuit selectively couples the unregulated power supply (VCC) to the internal power node (N20). The control output terminal (CTL) produces a signal at node N30, indicating that the unregulated power supply (VCC) has been transferred to the internal power node (N20).

The shutdown circuit (310) includes a high power supply terminal (VCC), an input control terminal (CTL), and an output control terminal (PCTL). The high power supply terminal (VCC) is coupled to the unregulated power supply (VCC). The control input terminal (CTL) is coupled to node N30. The output control terminal is coupled to the gate of the PMOS transistor (MP2C) at node N22. When activated by the input control terminal (CTL), the shut-down circuit couples the gate of the PMOS transistor (MP20) at node N22 to the VCC terminal to disable the PMOS transistor (MP20).

Although in FIG. 3 a PMOS transistor is used for regulation and the error amplifier monitors signals between the regulation and ground, the entire design can be rearranged for an NMOS transistor to regulate between the regulation voltage and ground instead of between the VCC terminal and the regulation voltage. In this instance, an NMOS transistor would be used and the resistors that provide the feedback for the error amplifier would be between the VCC terminal and the regulation voltage. In addition, diode D20 would be arranged differently so that that current would not flow back in that circuit arrangement.

The start up circuit (330) may be combined with the reference circuit, the supply transfer circuit, or other circuits that are part of the LDO regulator (300). Also, the shutdown circuit (310), and supply transfer circuit (320) may be combined into a single circuit. The start-up circuit, supply transfer circuit, and the shutdown circuit may also be combined into a single circuit.

Figure 4:
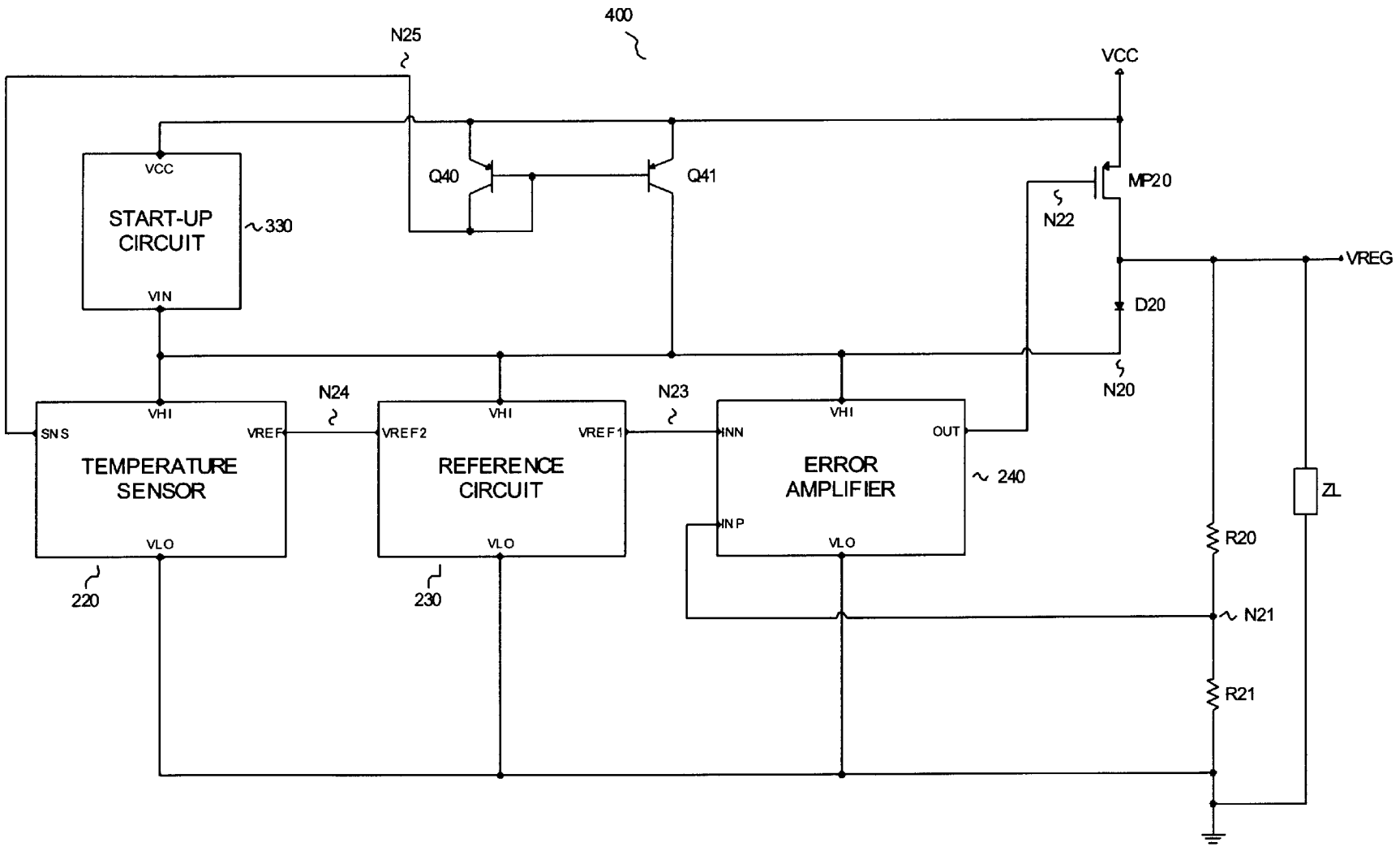
FIG. 4 is a schematic diagram illustrating an exemplary LDO regulator that is similar to the LDO regulator illustrated in FIG. 3.

Another example of the present invention is shown in FIG. 4. FIG. 4 is substantially the same as the example illustrated in FIGS. 2 and 3. The power control circuit (210) from FIG. 2 is replaced with a start-up circuit (330) and two bipolar transistors (Q40, Q41). The two bipolar transistors (Q40, Q41) operate as a supply transfer circuit in this example.

Transistor Q40 is a PNP transistor with a base and collected connected to node N25, and an emitter connected to the unregulated power supply (VCC). Transistor Q41 is a PNP transistor with a base connected to node N25, a collector connected to node N20, and an emitter connected to the unregulated power supply (VCC). Transistor Q40 is a diode-connected device that forms a current mirror with transistor Q41.

When the temperature sensor circuit (220) activates the SNS input terminal at node N25, transistor Q40 begins to conduct as a forward biased diode. Transistors Q40 and Q41 are arranged as a current mirror. As transistor Q40 begins to conduct, transistor Q41 will also conduct sharing a common base-emitter voltage. When transistor Q41 begins to conduct, the current flows from VCC directly to the internal components of the voltage regulator at node N20. Diode D20 prevents current from flowing between node N20 and the regulator output (VREG).

In this example of the present invention, the LDO regulator uses a PMOS transistor device as a pass transistor. Since the gate of the PMOS transistor requires very little current, it becomes possible to draw a very small constant current into the internal components of the voltage regulator, namely, into the reference circuit (230). In this example, the total current through the diode (D20) is roughly on the order of 400 nA. By using a current mirror (Q40, Q41), the sensed temperature is used to force the reference circuit (230) to be biased by the VCC power supply. In one example, transistor Q40 is roughly a unit transistor size while transistor Q41 is roughly ten times the unit transistor size, resulting in a 10 to 1 current mirror between transistors Q40 and Q41. The 10× transistor will saturate very close to the supply rail (VCC). In this instance, the reference circuit (230) will operate from the VCC power supply.

Transistor Q41 essentially operates as a switch coupling the VCC power supply to internal node N20. Although the circuits shown in FIG. 4 contain two bipolar transistors (Q40, Q41) for the power transfer circuit, other configurations are also possible. For example, a PMOS device may be used to control a bipolar switch, a PMOS device may be used to control a PMOS switch, a bipolar device may be used to control a PMOS switch and a bipolar device may also be used to control a bipolar switch. Other arrangements may also be made where the switching element is controlled by voltage instead of a current.

Figure 5:
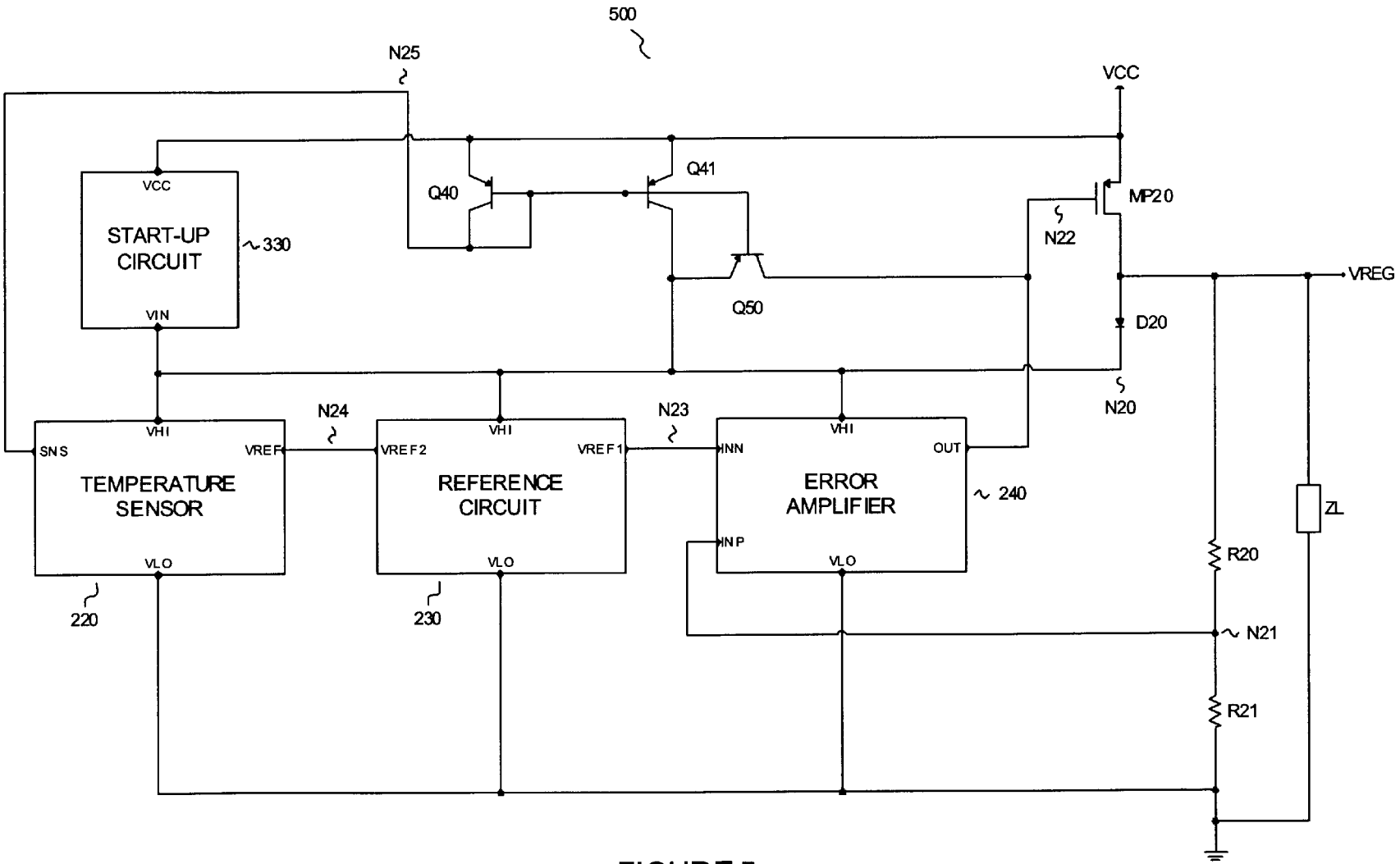
FIG. 5 is a schematic diagram illustrating another exemplary LDO regulator that is similar to the LDO regulator illustrated in FIG. 3.

Another example of the present invention is illustrated in FIG. 5. FIG. 5 shows an LDO regulator that is similar to that shown in FIG. 4, further including a shut-down circuit that is formed by bipolar transistor Q50.

Transistor Q50 is a PNP transistor that includes a base connected to node N25, a collector connected to node N22, and an emitter connected to node N20. PNP transistor Q50 is arranged to sense saturation of Q41 and shut down the control to the PMOS transistor at node N22.

Since the regulator uses a PMOS transistor (MP20) in the LDO, there is little sense in providing a strong gate drive to this transistor. The saturation sensing PNP transistor (Q50) proceeds to start shorting out the gate drive as soon as the supply voltage (VREG) gets within a nominal voltage of the upstream power supply (VCC). In one example of the present invention, the minimum drive that is necessary to activate bipolar transistor Q50 is roughly 100 mV.

As the operating temperature begins to approach a predetermined high temperature, the output of the temperature sensor will change from one state to another. The temperature sensor (220) activates transistor Q40, which causes transistor Q41 to begin switching the internal power supply at node N20 (the downstream regulated supply) to the VCC supply. However, transistor Q50 is not immediately activated. After the internal power supply at node N20 switches over from the regulated supply to the VCC supply through transistor Q41, the reference circuit (230) stabilizes. After the reference has stabilized with node 20 at VCC, the PMOS transistor (MP20) is deactivated through transistor Q50. Having read the instant disclosure, it is understood and appreciated that positive or negative feed back can be added to the system as would be desired to improve stability of performance.

Figure 6:
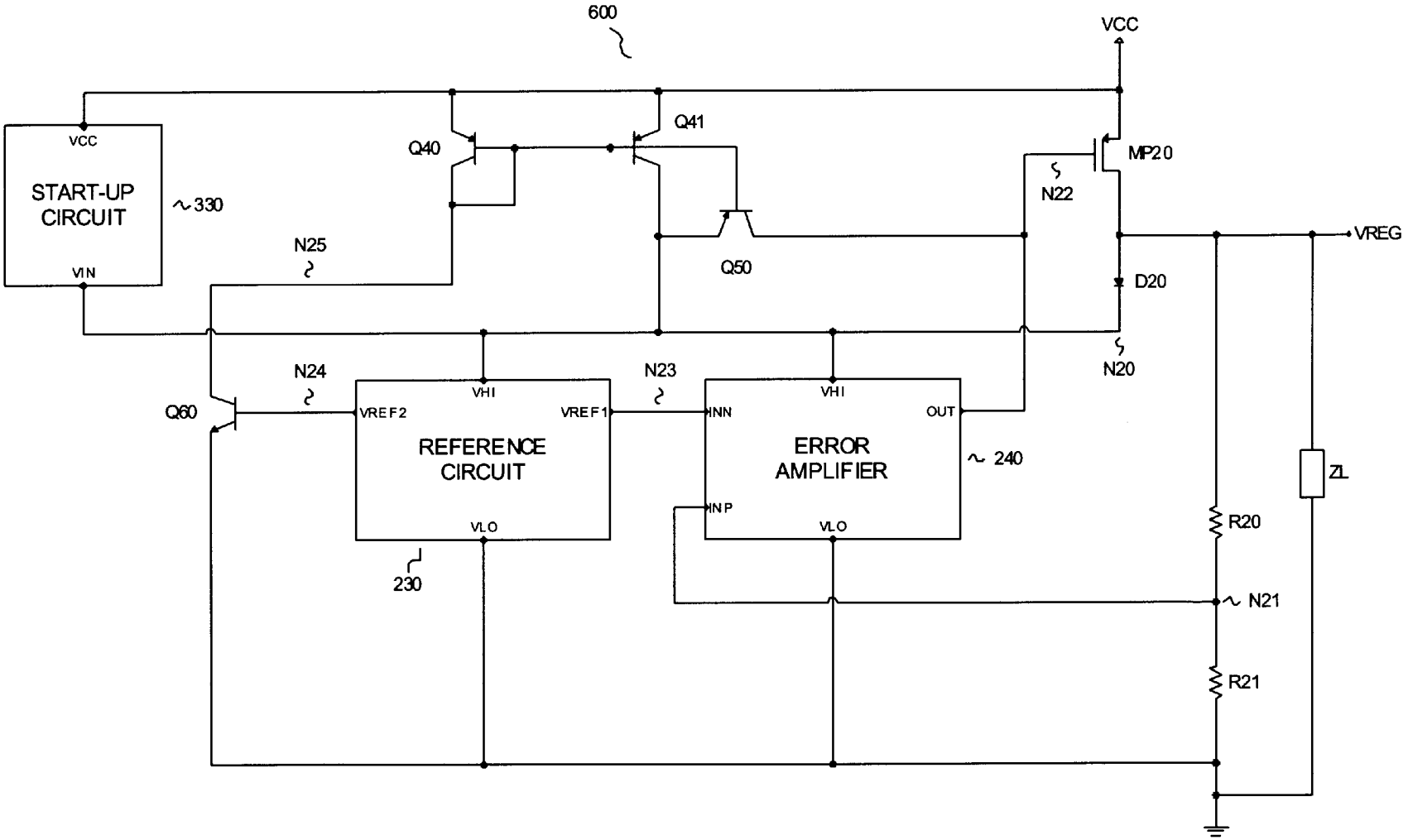
FIG. 6 is a schematic diagram illustrating yet another exemplary LDO regulator that is similar to the LDO regulator illustrated in FIG. 3, in accordance with the present invention.

Another example of the present invention is illustrated in FIG. 6. FIG. 6 shows an LDO regulator that is similar to the LDO regulator from FIG. 5 with the addition of transistor Q60. Transistor Q60 replaces the temperature sensor (220) shown in FIG. 5.

Transistor Q60 is an NPN transistor. The NPN transistor (Q60) has a collector tied to node N25, a base connected to node N24, and an emitter connected to the circuit ground potential (GND). During normal operation, bipolar transistor Q60 is not active. As temperature begins to rise, the threshold potential of transistor Q60 also begins to vary with temperature. The threshold potential of an NPN transistor is related to the thermal voltage, which is given by kT/q, where k is Boltsman's Constant, T is temperature in degrees Kelvin, and q is the charge of an electron. At a given current level, a bipolar transistor's base-emitter voltage changes at roughly −2 mV/° C. It can be shown that the threshold voltage of the bipolar transistor changes linearly with temperature. The second voltage reference output (VREF2) from the refer (nce circuit (230) is designed to have another temperature coefficient such that the output voltage (VREF2) at node N24 increases with temperature. When the operating temperature reaches a predetermined level, the base voltage of transistor Q60 exceeds the threshold voltage and transistor Q60 becomes active drawing current through transistor Q40.

It is understood and appreciated that other temperature based sensors can be made which include one or more transistors of either bipolar or MOS variety. The temperature sensor may also include other logical components such as an inverter or other logic as is necessary to activate or deactivate the related circuitry.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus that regulates a regulation voltage across a load from an unregulated power supply, comprising:

a series regulator circuit is arranged to selectively couple power from the unregulated power supply to the load in response to a control signal;

a feedback circuit is arranged to provide a feedback voltage from the regulation voltage, wherein the feedback voltage is at least a portion of the regulation voltage;

a power control circuit is arranged to selectively couple power from the unregulated power supply to an internal power supply when activated by an over-temperature signal;

a temperature sensor circuit is arranged to provide an over-temperature signal when an over-temperature condition is detected;

a diode circuit is arranged to couple power from the regulation voltage to the internal power supply when the power control circuit is deactivated such that the internal power supply is regulated when the power control circuit is deactivated; and an error amplifier circuit is arranged to produce the control signal in response to a reference voltage and the feedback voltage, wherein the error amplifier is arranged to operate from the internal power supply whereby the regulation voltage has an improved power supply rejection ratio.

2. An apparatus as in claim 1, wherein the series regulation circuit includes at least one of a bipolar junction transistor, a MOSFET transistor, a JFET transistor, and a GaAsFET transistor.

3. An apparatus as in claim 1, wherein the feedback circuit includes a resistor divider network that is arranged to provide the at least the portion of the regulation voltage.

4. An apparatus as in claim 1, further comprising a reference circuit that is arranged to provide the reference voltage, wherein the reference circuit is operated from the internal power supply.

5. An apparatus as in claim 1, wherein the power control circuit includes a power supply transfer circuit and a shutdown circuit, wherein the power supply transfer circuit is arranged to selectively transfer power from the unregulated power supply to the internal power supply when activated by the over-temperature signal, and the shutdown circuit is arranged to selectively disable the series regulator circuit when activated by the over-temperature signal.

6. An apparatus as in claim 1, further comprising a start-up circuit that is arranged to activate the series regular circuit during an initial start-up time interval such that power is delivered to the load and regulation is enabled.

7. An apparatus as in claim 5, wherein the power supply transfer circuit includes a bipolar transistor that is arranged to couple the unregulated power supply to the internal power supply when activated by a base current.

8. An apparatus as in claim 5, wherein the power supply transfer circuit includes a current mirror circuit that provides a first current path that is coupled to the over-temperature signal and a second current path that is coupled between the unregulated power supply and the internal power supply, wherein the first current path is activated by the over-temperature signal and the second current path is activated by the first current path.

9. An apparatus as in claim 5, wherein the shutdown circuit includes a coupling circuit that is arranged to couple the control signal to the unregulated power supply when activated by the over-temperature signal such that the series regulator circuit is disabled.

10. An apparatus as in claim 5, wherein the shutdown circuit includes a coupling circuit that is arranged to couple the control signal to the internal power supply when activated by the over-temperature signal, and wherein the power supply transfer circuit includes another coupling circuit that is arranged to couple the unregulated power supply to the internal power supply when activated by the over-temperature signal such that the series regulator circuit is disabled after the internal power supply transfer circuit has transferred the unregulated power supply to the internal power supply.

11. An apparatus as in claim 1, wherein the temperature sensor circuit includes a transistor that is biased by another reference voltage such that the transistor conducts a current when the over-temperature condition is sensed, wherein the over-temperature signal is associated with the current conducted by the transistor.

12. An apparatus that regulates a regulation voltage across a load from an unregulated power supply, comprising:

a means for regulating that selectively couples power from the unregulated power supply to the load in response to a control signal;

a means for coupling unregulated power that selectively couples power from the unregulated power supply to an internal power supply when activated by an over-temperature signal;

a means for sensing that produces an over-temperature signal when all over-temperature condition is detected;

a means for coupling regulated power that couples power from the regulation voltage to the internal power supply when the internal power supply is less than the regulation voltage;

a means for providing feedback that provides a feedback voltage from the regulation voltage, wherein the feedback voltage is at least a portion of the regulation voltage; and a means for controlling that provides the control signal in response to the feedback voltage and a reference voltage such that the regulation voltage across the load is regulated by the means for controlling and the means for regulating when the over-temperature signal is deactivated, wherein the means for controlling operates from the internal power supply.

13. An apparatus as in claim 12, further comprising a reference means that provides the reference voltage to the means for controlling, wherein the reference means operates from the internal power supply.

14. An apparatus as in claim 12, further comprising means for disabling that disables the means for regulating when the over-temperature signal is activated.

15. An apparatus as in claim 12, further comprising means for disabling that is arranged to provide power to the internal power supply during an initial start-up time interval such that the means for regulating delivers power from the unregulated power supply to the load.

16. A method for regulating a regulation voltage across a load from an unregulated power supply that has an associated unregulated power supply voltage, comprising:

controlling a series regulation circuit with a control signal;

coupling power from the unregulated power supply to the load in response to the control signal;

coupling power from the series regulation circuit to an internal power supply that has a corresponding internal power supply voltage when the internal power supply voltage is lower than the regulation voltage;

producing a feedback voltage that corresponds to at least a portion of the load regulation voltage;

producing a first and second reference voltage with a reference circuit;

producing the control signal with an error amplifier circuit in response to the feedback voltage to the first reference voltage;

sensing an over-temperature condition with a temperature sensor circuit that utilizes the second reference voltage;

producing the over-temperature signal in response to the over-temperature condition;

coupling the unregulated power supply to an internal power supply when activated by the over-temperature sensor signal;

disabling the series regulation circuit after coupling the unregulated power supply to the internal power supply; and operating the error amplifier circuit and the reference circuit from the internal power supply such that the regulation voltage has improved power supply rejection during regulation.

17. A method as in claim 16, further comprising coupling power to the internal power supply during an initial start-up time interval such that the error amplifier circuit and the reference circuit have sufficient power to begin regulation after the initial start-up time interval.

* * * * *